United States Patent [19]

Boissevain

[11] Patent Number: 4,671,173

[45] Date of Patent: Jun. 9, 1987

[54] STEAM JET CALENDER CONTROLLER WITH CONDENSATE SUCTION

[75] Inventor: Mathew G. Boissevain, Cupertino, Calif.

[73] Assignee: Measurex Corporation, Cupertino, Calif.

[21] Appl. No.: 727,368

[22] Filed: Apr. 25, 1985

[51] Int. Cl.[4] ..... B30B 15/34

[52] U.S. Cl. ..... 100/38; 100/47; 100/93 RP; 100/162 B; 29/113 AD; 72/13; 72/200

[58] Field of Search ..... 100/93 RP, 162 B, 38, 100/47, 168; 34/48, 54; 29/116 AD, 113 AD; 72/13, 16, 200, 201, 236

[56] References Cited

U.S. PATENT DOCUMENTS

| | | | |
|---|---|---|---|
| 334,415 | 1/1886 | Brewer | 100/93 RP |
| 1,366,581 | 1/1921 | Maxwell | 100/93 RP |
| 2,415,025 | 1/1947 | Grell et al. . | |
| 2,981,175 | 4/1961 | Goyette . | |
| 3,177,799 | 4/1965 | Justus et al. . | |
| 3,203,678 | 8/1965 | Sawyer et al. . | |
| 3,257,938 | 6/1966 | Goyette | 100/93 RP |
| 3,413,915 | 12/1968 | Goodwin et al. . | |
| 3,438,088 | 4/1969 | Westbrook et al. . | |
| 3,456,582 | 7/1969 | McClenathan . | |
| 3,521,325 | 7/1970 | Schippers et al. . | |
| 3,556,000 | 1/1971 | Goodwin et al. . | |
| 3,702,912 | 11/1972 | Greenberger . | |
| 3,770,578 | 11/1973 | Spurrell . | |
| 3,772,492 | 11/1973 | Brogden et al. . | |
| 4,114,528 | 9/1978 | Walker . | |
| 4,384,514 | 5/1983 | Larive et al. . | |
| 4,422,318 | 12/1983 | Christ et al. | 72/200 |
| 4,425,489 | 1/1984 | Pav et al. . | |

FOREIGN PATENT DOCUMENTS

| | | | |
|---|---|---|---|
| I143039 | 3/1983 | Canada . | |
| 575567 | 4/1958 | Italy . | |
| 67827A81 | 6/1981 | Italy . | |
| 226 | of 1911 | United Kingdom | 100/93 |
| 977098 | 12/1964 | United Kingdom . | |

OTHER PUBLICATIONS

Pulp & Paper Magazine, Nov. 1984, pp. 54–55 and Dec. 1984, p. 157.

*Primary Examiner*—Peter Feldman

*Attorney, Agent, or Firm*—Spensley Horn Jubas & Lubitz

[57] ABSTRACT

A device for selectively controlling the diameter of sections of a calender roll. The device comprises a plurality of nozzles which direct jets of superheated steam against sections of the calender roll. Thermal expansion, resulting from localized heating by the steam jets, corrects local non-uniformities in the gap between adjacent cooperating calender rolls. Moisture which condenses from the steam onto the calender roll surface is removed by a flow of air past the roll surface.

25 Claims, 4 Drawing Figures

STEAM JET CALENDER CONTROLLER WITH CONDENSATE SUCTION

BACKGROUND OF THE INVENTION

The present invention relates to the field of calenders, and more particularly to devices for controlling the diameter of rolls used in calenders or analogous machines.

Pressing a material between two calender rolls can change the physical characteristics of the material. For example, calendering paper can change its density, thickness and surface features. Thus, the calendering process is frequently used in the manufacture of paper and other sheet materials where it is often desirable to change the density, thickness or surface features of the material.

A common problem associated with calendering is an uneven thickness of the calendered material, or "web". Localized variations in a variety of parameters affect the diameter of individual calendar rolls and create variations in the spacing or "nip" between cooperating rolls. Variations in the nip across the width of a pair of calender rolls produces a web having non-uniform thickness. Thus, a more uniform thickness could be obtained if the local diameters of the rolls could be controlled.

If the rolls are made of a material that responds to changes in temperature, one may control local roll diameters by varying the temperature of selected cylindrical sections of the calender roll. Previous devices have used this principle by directing jets of hot or cold air against sections of a rotating calender roll to control its local diameters. Many of these devices blow hot air from a supply plenum against sections of the calender roll to increase the diameter of the roll and thus decrease the thickness of the web. Alternatively, when these devices release cold air from a second supply plenum against selected cylindrical sections of the calender roll, those sections contract. This decreases the local roll diameter and increases the thickness of the web. Examples of such devices are shown in U.S. Pat. No. 4,114,528 to Walker and U.S. Pat. No. 3,770,578 to Spurrell.

These previously known devices, however, are subject to certain limitations and inefficenicies. For example, the nip control range is determined by the maximum and minimum temperatures of the air jets. The air in the hot air plenum is usually pressurized by a blower and heated by steam from the facility power plant. Typically, however, steam supplied by such a power plant is waste steam, having a maximum temperature of about 350° F. Inefficiencies in the heat exchange process further limit the maximum temperature of such steam heated air to about 325° F.

The calender roll control device of the present invention has a number of features which overcome many of the disadvantages of many air jet control devices heretofore known. For example, the present invention uses jets of steam to heat the calender roll. The direct use of steam avoids the inefficiencies in the air heating process. Additionally, since the invention uses steam jets rather than steam-heated air, the higher temperature provides a greater control range then conventional hot air devices. Furthermore, the invention does not require a blower to pressurize an air plenum. Instead, the steam plenum used with the present invention is pressurized directly by the thermal energy of the steam.

Another type of prior calender roll control device uses magnetic fields to heat the calender roll, for example, as shown in U.S. Pat. No. 4,384,514 to Larive et al. In this type of device, the roll is made of a conducting material and magnets are positioned close to the roll surface. As the rotating roll passes under the magnets, cylindrical sections of the roll are heated by magnetic induction. The magnetic fields induce currents in the calender roll which dissipate their energy heating the roll. However, because ordinary 50/60 Hz electromagnets have high magnetic forces which may bend the roll, 25 Khz alternating current electromagnets are generally used. Thus, effective magnetic induction calender roll control devices require a special alternating current power supply.

Furthermore, to achieve the greatest heating effect, the magnets should be positioned within about ⅛" of the roll surface. However, placing the magnets this close to the calender roll may lead to damage when the web breaks. The broken web can wrap around the roll a sufficient number of times to build up a thick layer of calendered material on the roll. Once the layer becomes more than ⅛" thick, the rotating calender roll can drive the paper into the magnets with sufficient force to damage both the magnets and their supporting structure.

The device of the present invention also provides a number of advantages over magnetic induction calender roll control devices. For example, the invention does not require a special alternating current power supply to energize electromagnets. Instead, the invention heats the calender rolls with steam which is generally a less costly form of energy then electricity. Electric power is a relatively expensive energy source since the steam to electric power conversion process is usually only about 44% efficient. The direct use of steam to heat the calender roll is more economical. Furthermore, depending upon the particular application, the steam nozzles used in the present invention to direct steam jets against the calender roll are usually positioned approximately two inches from the roll surface. This two inch gap between the nozzles and the calender roll greatly decreases the possibility of damage to the nozzle by contact with the calendered material.

The present invention thus provides a number of advantages over prior art calender roll control devices. These and other advantages will become apparent in the description which follows.

SUMMARY OF THE INVENTION

The present invention is directed toward a controller for controlling local calender roll diameters by selectively directing jets of steam against sections of the calender roll. The roll is made of a material having at least one dimension which responds to changes in temperature. Therefore, thermal expansion, resulting from localized heating by the steam jets, corrects non-uniformities in the nip formed between cooperating calender rolls. Moisture that condenses from the steam onto the roll surface is removed before it wets the calendered material.

In the illustrated embodiments, the invention comprises a plurality of nozzles which direct jets of steam at a rotating calender roll. The nozzles are dispersed at intervals along the length of the roll so that steam escaping from each nozzle affects the diameter of a particular section of the roll. A valve associated with each nozzle controls the volume of steam discharged by the nozzle. When a valve opens, steam escapes from the associated nozzle and heats the adjacent section of the calender roll. This steam heating causes the adjacent section of calender roll to expand, thereby contracting the nip formed between cooperating calender rolls. As a result, the narrowed section of nip produces a thinner web.

The steam is preferrably superheated to minimize condensation of the roll. Condensation will wet the calendered material, which may be adversely affected by water. Any condensation which does occur, however, may be sucked off the surface of the roll by a vacuum plenum having an inlet port near the surface of the roll. Furthermore, the steam jets are preferrably directed against the side of the calender roll moving away from the nip. As the hot calender roll rotates, the exposed area of the roll travelling from the steam jets back to the nip allows any remaining condensate to evaporate before reaching the nip.

To maintain a uniform thickness of calendered material, a valve control device controls the valves and hence the heating of each section of the calender roll. In the illustrated embodiments, a web thickness sensor measures the thickness of the web at intervals along its width and generates signals corresponding to the measured thicknesses. The signals from the sensor are fed to a valve control device which maintains a uniform web thickness by adjusting the steam valves to thereby control the diameter of particular sections of the temperature sensitive calender roll.

DETAILED DESCRIPTION OF THE PREFERRED EMBODIMENTS

Figure 1:
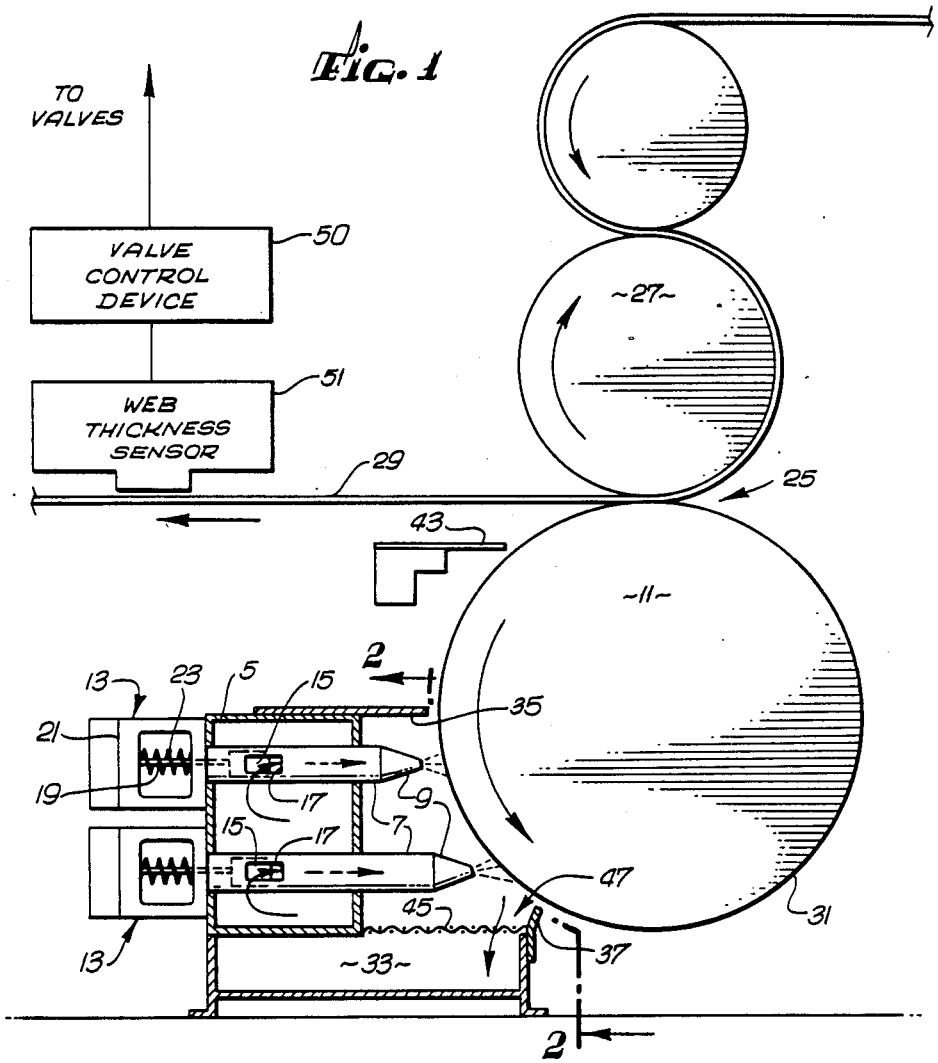
FIG. 1 is a cross-sectional view of one embodiment of the present invention having two rows of steam jets directed against the lowermost calender roll and a vacuum plenum for removing moisture from the roll.

The first embodiment of the present invention is illustrated in FIG. 1. The invention comprises a steam plenum 5 containing superheated steam at 500° F. and 10 psig. A plurality of hollow cylinders 7 communiate with the interior of the plenum 5 so that steam from the plenum 5 enters the cylinders 7. A nozzle 9 is positioned at the exterior end of each cylinder 7 to direct a jet of steam against adjacent sections of the calender roll 11 to control its local diameters.

A valve 13 associated with each hollow cylinder 7 controls the flow of steam from the plenum 5 to each nozzle 9. Each valve 13 comprises a plug 15 which gradually opens and closes an orifice 17 located in the wall of the cylinder 7. A rod 19 controls the plug 15 which in turn is controlled by air pressure acting on a diaphragm 21. The air pressure works against a spring 23 which holds the plug 15 in the closed position. Increasing the air pressure displaces the plug 15 away from the orifice 17, thereby allowing more steam to escape through the nozzle 9.

When a valve 13 opens, steam escapes from the plenum 5 through the hollow cylinder 7 and its associated nozzle 9. The steam jet heats the section of calender roll 11 which is adjacent to the nozzle 9. As the temperature of the heated section of calender roll 11 increases, the thermally expanding roll 11 decreases the size of the nip 25 formed between the heated section of calender roll 11 and the adjacent cooperating roll 27. Thus, the heated section of calender roll 11 produces a thinner section of calendered material 29.

The steam in the plenum 5 is superheated by a steam superheating device 30 (see FIG. 2) to minimize condensation on the calender roll 11 which may otherwise wet the calendered material 29. However, any steam which does condense on the roll 11 is sucked off the roll surface 31 by a vacuum plenum 33.

Figure 2:
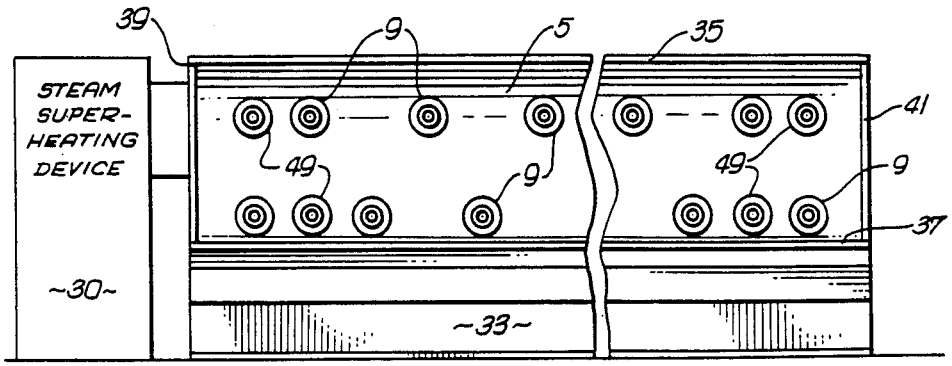
FIG. 2 is a front view of the steam jet and plenum structure taken along the line 2—2 of FIG. 1.

Four shims provide a means for substantially enclosing the volume bonded by the steam plenum 5, the calender roll 11, and the vacuum plenum 33. Two of the shims 35, 37 are illustrated in FIG. 1. The two remaining shims 39, 41 are illustrated in FIG. 2, which is a front view of the device along the line 2—2 of FIG. 1. The first shim 35 extends between the top of the steam plenum 5 and the calender roll 11. The second shim 37 is positioned between the vacuum plenum 33 and the calender roll 11. The two remaining shims 39, 41, illustrated in FIG. 2, are positioned at either end of the plenums and complete the enclosure. Therefore, air sucked into the vacuum plenum 33 passes through the narrow gap between the shims 35, 37, 39, 41 and the calender roll 11. The flow of air rushing through this gap removes condensate from the calender roll surface 31 and is sucked into the vacuum plenum 33.

To further insure that no condensate wets the calendered material 29, the steam jets are located on the side of the calender roll 11 which moves away from the nip 25. The roll is typically maintained at an average temperature of about 190° F. Therefore, the exposed area of the hot calender roll 11 extending from the second shim 37 to the nip 25 evaporates any remaining condensate before it reaches the nip 25.

A doctor blade 43 extends along the length of the calender roll 11 and is positioned above the calender roll control device to protect the device from pieces of the calendered material which may break off of the calendered sheet 29. The vacuum plenum 33 is also protected by a filter 45. The filter 45 covers the inlet port 47 of the vacuum plenum 33 and prevents particles of the calendered material or other foreign matter from entering the vacuum plenum 33.

As shown in FIG. 2, a plurality of nozzles 9 are positioned along the length of the steam plenum 5. The nozzles 9 are disposed in two rows and dispersed at intervals along the length of the plenum 5 corresponding to sections of the calender roll 11 whose diameters are to be controlled. Typically, each section of calender roll or "slice" is about six inches wide. However, depending upon the particular situation, each slice may be wider or narrower. Additional nozzles 49 are located near the ends of the plenum 5 to compensate for the increased cooling tendency of the calender roll ends.

As shown in FIG. 1, a computerized valve control device 50 controls the heating of each section of the calender roll 11 to maintain a uniform thickness of calendered material 29. A web thickness sensor 51 senses the thickness of the calendered material 29 at various locations along its width and sends signals, which correspond to the thicknesses of the material, to the control device 50. Depending on the degree of deviation of the calendered material 29 from the desired thickness, the valve control device 50 selectively directs air pressure against certain diaphragms 21 which in turn adjust the associated valves 13 so that the valves discharge a greater or lesser amount of steam from each nozzle 9.

If the sensor 51 detects a thick section of calendered material 29, the control device 50 adjusts the valve 13 adjacent to that section of the calender roll 11 and allows more steam to heat that section of the roll 11. The additional steam heating the section of the calender roll 11 causes it to expand. The expanding section of the calendar roll 11 decreases the corresponding section of nip 25, thus decreasing the thickness of the calendered material 29 produced by the heated section of the roll 11.

Alternatively, when the sensor 51 detects a thin section of calendered material 29, the control device 50 adjusts the valve 13 adjacent to that section of the calender roll 11 to allow less steam to heat the roll 11. Since less steam is directed at that section of the roll 11, it cools and contracts. This increases the nip 25 formed between the cooperating calender rolls 11, 27 and results in a thicker section of calendered material 29.

Figure 3:
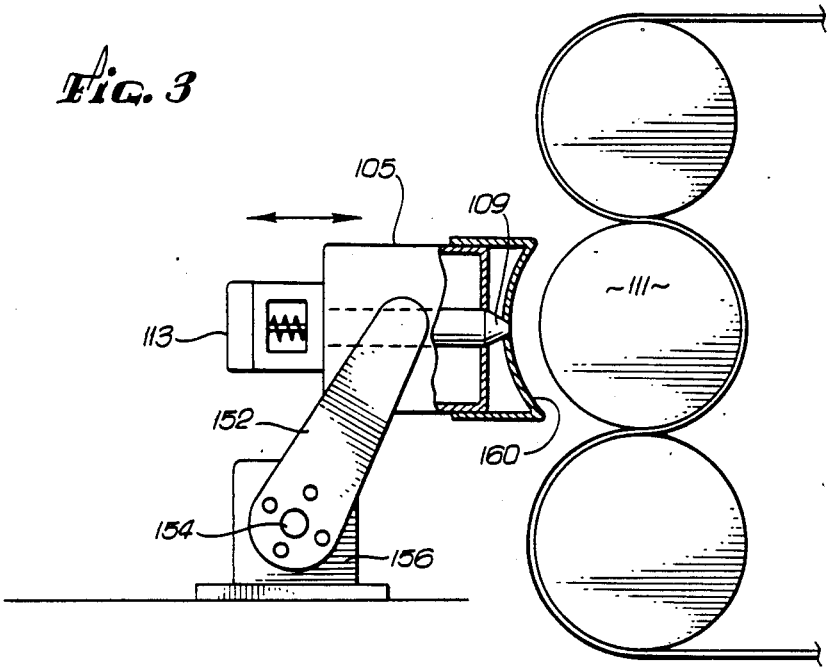
FIG. 3 illustrates another embodiment of the present invention having a single row of steam jets directed against an intermediate calender roll and a shroud for preventing cold air entrainment.

FIG. 3 illustrates a second preferred embodiment of the present invention. It operates in essentially the same manner as the first embodiment. However, the plenum 105 is supported by an arm 152 and positioned so that a single row of nozzles 109 direct steam against an intermediate calender roll 111. Furthermore, although a vacuum plenum could be used with this device, FIG. 3 illustrates operation without a vacuum plenum.

The steam jet nozzles 109 are shown protruding from a concave shroud 160 having approximately the same curvature as the surface of the calender roll 111. The shroud 160 acts to constrain the steam emitted from the nozzles 109 to remain in contact with the calender roll 111, thus enhancing the efficiency of the heat transfer to the roll 111. The shroud 160 also prevents cold ambient air from being entrained by the steam jets. The cold air would reduce the effective temperature of the jets. Of course, a similar shroud could be used with the embodiment of the invention illustrated in FIG. 1.

The support member of arm 152 is mounted on the drive shaft 154 of a motor 156. When the motor 156 is activated, the drive shaft 154 and supporting arm 152 pivot the plenum 105, nozzles 109, valves 113 and shroud 160 away from the calender roll 111 for convenient inspection, repair or replacement of the device.

Figure 4:
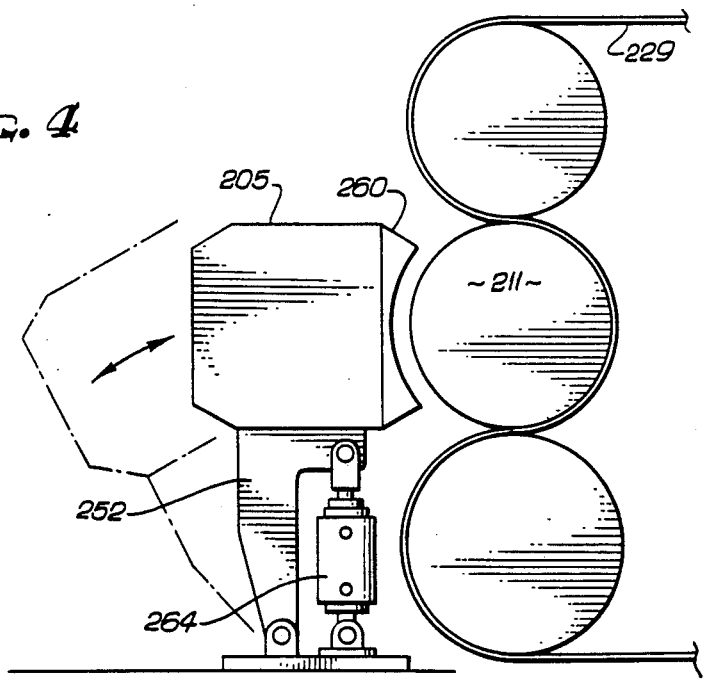
FIG. 4 illustrates still another embodiment of the present invention supported by an over-center support mechanism.

Alternatively, the calender roll control device may be supported by an over-center support mechanism, as shown in FIG. 4. In this embodiment, a rigid pivotable support member on arm 252 is disposed at either end of the steam plenum 205. These arms 252 support the plenum 205 so that the plenum 205 and shroud 260 are pivotable toward or away from the calender roll 211.

An extendible air cylinder 264 is associated with each pivotable arm 252. Pressurizing the cylinders 264 with air causes them to expand, thus rocking the plenum 205 and shroud 260 away from the calender roll 211.

In the operating position, each air cylinder 264 is pressurized so that the calender roll control device leans slightly toward the calender roll 211. In this metastable position, if the web 229 breaks and wraps around the roll 211, a slight forceful contact between the web 229 and the shroud 260 is sufficient to rock the device back away from the calender roll 211 and thus avoid damage to the device.

Three embodiments of the present invention have been described. Nevertheless, it is understood that one may make various modifications without departing from the spirit and scope of the invention. Thus, the invention is not limited to the embodiments described herein.

I claim:

1. A calender roll control device of a type which uses heat to control the diameter of a calender roll having a roll diameter which responds to changes in temperature and thereby control the thickness of a sheet of calenderable material passing between the temperature responsive calender roll and a cooperating second calender roll, the device comprising:

a plurality of nozzles for directing jets of superheated steam against the exterior surface of a temperature responsive calender roll;

steam supply means for supplying superheated steam to each of the nozzles;

steam control means for separately controlling the amount of superheated steam emitted by each of the nozzles; and a vacuum plenum having an inlet port disposed adjacent to the nozzles such that water condensing from the steam which escapes from each of the nozzles is directed into the vacuum plenum.

2. A calender roll control device as in claim 1, further comprising a concave shroud disposed around the nozzles.

3. A calender roll control device as in claim 1, wherein the steam supply means comprises a steam plenum in flow communication with the nozzles.

4. A calender roll control device as in claim 3, further comprising at least one support member pivotally supporting the steam plenum.

5. A calender roll control device as in claim 4, further comprising at least one extendible member associated with the support member so that the pivotal position of the support member is controlled by extending or retracting the associated extendible member.

6. A calender roll control device as in claim 1, wherein the steam control means comprises:

a thickness sensor for measuring the thickness of the calenderable material and producing signals in response thereto;

a valve associated with each nozzle for regulating the amount of steam emitted by the associated nozzle; and a valve control device for controlling the valve associated with each nozzle in response to the signals from the thickness sensor.

7. A calender roll control system of a type which uses heat to control the diameter of a calender roll and thereby control the thickness of a sheet of calenderable material, the system comprising:

a first calender roll having a diameter which responds to changes in temperature and an axis of rotation;

at least one cooperating second calender roll adjacent to the first calender roll and having an axis of rotation substantially parallel to the axis of rotation of the first calender roll;

calenderable material passing between the first and second calender rolls;

a plurality of nozzles disposed at intervals along the axial length of the first calender roll, said nozzles directing superheated steam against the exterior surface of the temperature responsive first calender roll;

steam supply means for supplying superheated steam to the nozzles, said steam being superheated to minimize condensation when the steam contacts the surface of the first calender roll;

steam control means for separately controlling the amount of superheated steam emitted by each nozzle.

8. A calender roll control system as in claim 7, further comprising a concave shroud having approximately the same curvature as the surface of the first calender roll and wherein the shroud is disposed around the nozzles such that the curvature of the shroud is aligned with the curvature of the first calender roll.

9. A calender roll control system as in claim 7, wherein the steam supply means comprises a steam plenum in flow communication with the nozzles.

10. A calender roll control system as in claim 9, further comprising at least one support member pivotally supporting the plenum.

11. A calender roll control system as in claim 10, further comprising at least one extendible member associated with the support member so that the pivotal position of the support member is controlled by extending or retracting the associated extendible member.

12. A calender roll control system as in claim 7, further comprising a vacuum plenum having an inlet port disposed adjacent to the exterior surface of the first calender roll such that water condensing from the steam onto the exterior surface of the first calender roll is directed into the vacuum plenum.

13. A calender roll control system as in claim 12, further comprising:

enclosing means for substantially enclosing a volume containing the vacuum plenum inlet port, the nozzles, and a portion of the exterior surface of the first calender roll adjacent to the nozzles and wherein the enclosing means defines a gap adjacent to the exterior surface of the first calender roll for the admission of air such that water condensing from the steam is removed from the exterior surface of the first calender roll by a flow of air through the gap adjacent to the exterior surface of the first calender roll.

14. A calender roll control system as in claim 13, further comprising a filter covering the vacuum plenum inlet port.

15. A calender roll control system as in claim 7, wherein the steam control means comprises:

a thickness sensor for measuring the thickness of the calenderable material at a plurality of locations across the width of the material and producing signals in response thereto;

a valve associated with each nozzle for regulating the amount of steam emitted by associated nozzle; and a valve control device for controlling the valve associated with each nozzle in response to the signals from the thickness sensor.

16. A method of controlling with heat the diameter of a calender roll and thereby controlling the thickness of a sheet of calenderable material, the method comprising the steps of:

providing a first calender roll having a diameter which responds to changes in temperature;

providing a surface adjacent to the surface of the first calender roll;

passing a sheet of calenderable material between the first calender roll and the adjacent surface;

directing a plurality of jets of superheated steam against the exterior surface of the first calender roll, said jets impinging upon said exterior surface at intervals along the axial length of the first roll;

measuring the thickness of the sheet of calenderable material at a plurality of locations across the width of the sheet;

comparing the measured thicknesses of the sheet of calenderable material with a desired thickness and;

controlling the amount of steam directed against the exterior surface of the first calender roll by the jets of superheated steam based upon differences between the measured thicknesses and the desired thickness of the sheet of calenderable material.

17. The method as defined in claim 16, wherein the adjacent surface is the surface of a second calender roll.

18. The method as defined in claim 17, further comprising the step of:

removing water from the surface of the first calender roll with a flow of air.

19. A calender roll control system of a type which uses heat to control the diameter of a calender roll and thereby control the thickness of a sheet of calenderable material, the system comprising:

a first calender roll having a diameter which responds to changes in temperature and an axis of rotation;

at least one cooperating second calender roll adjacent to the first calender roll and having an axis of rotation substantially parallel to the axis of rotation of the first calender roll;

calenderable material passing between the first and second calender rolls;

at least one nozzle directing superheated steam against the exterior surface of the temperature responsive first calender roll;

a steam supply plenum for supplying superheated steam to the nozzle to minimize condensation of the steam upon contact with the temperature responsive first calender roll;

a vacuum plenum having an inlet port disposed adjacent to the exterior surface of the first calender roll;

means for substantially enclosing a volume containing the vacuum plenum inlet port, the nozzle, and a portion of the exterior surface of the first calender roll adjacent to the nozzle and wherein the enclosing means defines a gap adjacent to the exterior surface of the first calender roll for the admission of air such that water condensing from the steam is removed from the surface of the first calender roll by a flow of air through the gap adjacent to the first calender roll surface;

a thickness sensor for measuring the thickness of the calenderable material and producing signals in response thereto;

a valve associated with the nozzle for regulating the amount of steam released through the associated nozzle; and a valve control device for controlling the valve associated with the nozzle in response to the signals from the thickness sensor.

20. A calender roll control device of a type which uses heat to control the diameter of a calender roll having a roll diameter which responds to changes in temperature and thereby control the thickness of a sheet of calenderable material passing between the temperature responsive calender roll and a cooperating calender roll, the device comprising:

at least one nozzle for directing steam against the temperature responsive calender roll;

steam supply means for supplying steam to the nozzle, said steam supply means including a steam plenum in flow communication with the nozzle;

steam control means for controlling the amount of steam emitted by the nozzle;

a vacuum plenum having an inlet port disposed adjacent to the nozzle such that water condensing from the steam which escapes from the nozzle is directed to the vacuum plenum; and at least one support member pivotally supporting the steam plenum.

21. A calender control device as in claim 20, further comprising at least one extendable member associated with the support member so that the pivotal position of the support member is controlled by extending or retracting the associated extendable member.

22. A calender roll control device of a type which uses heat to control the diameter of a calender roll having a roll diameter which responds to changes in temperature and thereby control the thickness of a sheet of calenderable material passing between the temperature responsive calender roll and a cooperating calender roll, the device comprising:

at least one nozzle for directing steam against the temperature responsive calender roll;

steam supply means for supplying steam to the nozzle;

a thickness sensor for measuring the thickness of the calenderable material and producing signals in response thereto;

a valve associated with the nozzle for regulating the amount of steam released through the associated nozzle; and a valve control device for controlling the valve associated with the nozzle in response to the signals from the thickness sensor; and a vacuum plenum having an inlet port disposed adjacent to the nozzle such that water condensing from the steam which escapes from the nozzle is directed into the vacuum plenum.

23. A calender roll control system of a type which uses heat to control the diameter of a calender roll and thereby control the thickness of a sheet of calenderable material, the system comprising:

a first calender roll having a diameter which responds to changes in temperature and an axis of rotation;

at least one cooperating second calender roll adjacent to the first calender roll and having an axis of rotation substantially parallel to the axis of rotation of the first calender roll;

calenderable material passing between the first and second calender rolls;

at least one nozzle for directing steam against the temperature responsive calender roll;

a steam plenum in flow communication with the nozzle for supplying steam to the nozzle;

steam control means for controlling the amount of steam emitted by the nozzle;

at least one support member pivotally supporting the plenum; and at least one extendable member associated with the support member so that the pivotable position of the support member is controlled by extending or retracting the associated extendable member.

24. A calender roll control system of a type which uses heat to control the diameter of a calender roll and thereby control the thickness of a sheet of calenderable material, the system comprising:

a first calender roll having a diameter which responds to changes in temperature and an axis of rotation;

at least one cooperating second calender roll adjacent to the first calender roll and having an axis of rotation substantially parallel to the axis of rotation of the first calender roll;

calenderable material passing between the first and second calender rolls;

at least one nozzle for directing steam against the temperature responsive first calender roll;

steam supply means for supplying steam to the nozzle;

steam control means for controlling the amount of steam emitted by the nozzle;

a vacuum plenum having an inlet port disposed adjacent to the first calender roll such that water condensing from the steam onto the first calender roll is directed into the vacuum plenum; and enclosing means for substantially enclosing a volume containing the vacuum plenum inlet port, the nozzle, and a portion of the first calender roll surface adjacent to the nozzle and wherein the enclosing means defines a gap adjacent to the first calender roll surface for the admission of airsuch that water condensing from the steam is removed from the surface of the first calender roll by a flow of air through the gap adjacent to the first calender roll surface.

25. A calender roll control system as in claim 24, further comprising a filter covering the vacuum plenum inlet port.

* * * * *